US006624600B1

(12) United States Patent
Henze

(10) Patent No.: US 6,624,600 B1
(45) Date of Patent: Sep. 23, 2003

(54) LAMP POWER MEASUREMENT CIRCUIT

(75) Inventor: Christopher P. Henze, Lakeville, MN (US)

(73) Assignee: Nicollet Technologies Corporation, Minneapolis, MN (US)

( * ) Notice: Subject to any disclaimer, the term of this patent is extended or adjusted under 35 U.S.C. 154(b) by 0 days.

(21) Appl. No.: 10/099,596

(22) Filed: Mar. 13, 2002

(51) Int. Cl.[7] ..... G05F 1/00

(52) U.S. Cl. ..... 315/291; 315/307; 315/209 SC; 315/224; 315/299

(58) Field of Search ..... 315/291, 194, 315/224, 307, 297, 209 SC, 287, 299, 274, 276

(56) References Cited

U.S. PATENT DOCUMENTS 5,485,061 A * 1/1996 Ukita et al. ..... 315/307
5,491,387 A * 2/1996 Saito ..... 315/307
5,578,908 A 11/1996 Persson ..... 315/307
6,153,987 A * 11/2000 Toda et al. ..... 315/308

* cited by examiner

*Primary Examiner*—Don Wong
*Assistant Examiner*—Tuyet T. Vo
(74) *Attorney, Agent, or Firm*—Westman, Champlin & Kelly

(57) ABSTRACT

A lamp power measurement circuit measures average power delivered to a gas discharge lamp. The circuit includes a voltage sensor having a first measurement output representative of AC voltage across the lamp and a current sensor having a second measurement output representative of AC current through the lamp. A first absolute value circuit is coupled in series with the first measurement output and has a first absolute value output. A second absolute value circuit is coupled in series with the second measurement output and has a second absolute value output. A pulse width modulator modulates one of the first and second absolute value outputs with the other of the first and second absolute value outputs and has a pulse width modulated output. A low-pass filter is coupled in series with the pulse width modulated output and has a DC voltage output representative of average power dissipated through the lamp.

22 Claims, 2 Drawing Sheets

LAMP POWER MEASUREMENT CIRCUIT

FIELD OF THE INVENTION

The present invention is directed to gas discharge lamps. More specifically, the present invention is directed to a control circuit for operating a gas discharge lamp and measuring the average power delivered to the lamp.

BACKGROUND OF THE INVENTION

Gas discharge lamps are used in a variety of applications. For example, mercury vapor lamps are used for ultraviolet (UV) curing of ink in printing presses, for curing furniture varnish, in germicide equipment for killing germs in food and its packaging and for killing bacteria in medical operating rooms. Many other applications also exist.

A traditional circuit for controlling a mercury vapor lamp includes an AC power source which drives a primary side of a ballast transformer. A secondary side of the transformer is coupled to the lamp. The lamp includes a gas-filled tube with electrodes at each end of the tube. The secondary side of the transformer applies a voltage between the electrodes which accelerates electrons in the tube from one electrode toward the other. The electrons collide with gas atoms to produce positive ions and additional electrons. Since the current applied to the gas discharge lamp is alternating, the electrodes reverse polarity each half cycle.

Since the collisions between the electrons and the gas atoms generate additional electrons, an increase in the arc current causes the impedance of the lamp to decrease. This characteristic is known as "negative resistance." The lamp is unstable, and current between the electrodes must be limited to avoid damaging the lamp. As a result, a typical control circuit includes a current limiting inductance coupled in series with the lamp. The inductance can either be a physically separate inductor or "built-in" to the transformer as a leakage inductance.

When the lamp is first started, the lamp requires a very large striking voltage to initiate an arc to ionize the gas in the lamp. The electrodes of the lamp are cold and there are almost no free electrons in the tube. The impedance of the lamp is therefore very high. The voltage required to initiate the arc exceeds that required to sustain the arc. For example, the ignition voltage may be 1,000 volts while the operating voltage may be 550 volts.

One circuit for operating a gas discharge lamp and controlling its intensity is disclosed in U.S. Pat. No. 5,578,908, which is assigned to Nicollet Technologies Corporation of Minneapolis, Minn. This circuit uses a pair of anti-parallel silicon-controlled rectifiers (SCR's) in series with the primary side of the ballast transformer for controlling the average AC power delivered to the primary winding and thus to the gas discharge lamp.

In most gas discharge lamp applications, there is a desire to control the light output accurately. The actual light output is proportional to the average power dissipated through the lamp. The average power dissipated through the lamp is the instantaneous product of the lamp voltage and lamp current averaged over one or more cycles. However, most traditional lamp control circuits control intensity by measuring either the lamp voltage or the lamp current which, by itself, does not give an accurate representation of the actual light output.

If the average lamp power was known, this value could be used to more accurately control curing times in UV curing processes and sterilization times in germicide equipment.

One known method of obtaining the average lamp power is to use expensive test equipment, such as a digital oscilloscope. However, such test equipment is expensive, labor intensive and requires specialized knowledge to obtain and interpret its output. Alternatively, commercially available integrated circuits are available which could be used to digitize the lamp voltage and lamp current, multiply the digital values and average the results over time. However, these integrated circuits are also very expensive, and would therefore significantly increase the cost of the lamp control circuit.

Improved lamp control circuits are therefore desired, which have the ability to measure the average lamp power with relatively little added cost to the overall circuit.

SUMMARY OF THE INVENTION

One embodiment of the present invention is directed to a lamp power measurement circuit, which measures average power delivered to a gas discharge lamp. The circuit includes a voltage sensor having a first measurement output representative of AC voltage across the lamp and a current sensor having a second measurement output representative of AC current through the lamp. A first absolute value circuit is coupled in series with the first measurement output and has a first absolute value output. A second absolute value circuit is coupled in series with the second measurement output and has a second absolute value output. A pulse width modulator modulates one of the first and second absolute value outputs with the other of the first and second absolute value outputs and has a pulse width modulated output. A low-pass filter is coupled in series with the pulse width modulated output and has a DC voltage output representative of average power dissipated through the lamp.

Another embodiment of the present invention is directed to a gas discharge lamp control circuit, which includes alternating-current (AC) input terminals, lamp output terminals for coupling across a gas discharge lamp, and a ballast coupled between the AC input terminals and the lamp output terminals. A voltage sensor is coupled in the circuit to produce a first measurement output representative of AC voltage across the lamp output terminals. A current sensor is coupled in the circuit to produce a second measurement output representative of AC current through the lamp output terminals. A first absolute value circuit is coupled in series with the first measurement output and has a first absolute value output. A second absolute value circuit is coupled in series with the second measurement output and has a second absolute value output. A pulse width modulator modulates one of the first and second absolute value outputs with the other of the first and second absolute value outputs and has a pulse width modulated output. A low-pass filter is coupled in series with the pulse width modulated output and has a DC voltage output representative of average power dissipated through the lamp.

Another embodiment of the present invention is directed to a method of measuring power delivered to a gas discharge lamp by a lamp control circuit. The method includes: sensing a voltage representative of AC voltage delivered to the lamp and producing a first measurement output; sensing a current representative of AC current delivered to the lamp and producing a second measurement output; taking the absolute values of the first and second measurement outputs; pulse-width modulating one of the absolute values of the first and second measurement outputs with the other of the absolute values of the first and second measurement outputs to produce a pulse-width modulated output; and low-pass filtering the pulse-width modulated output to produce a DC voltage representative of average power delivered to the lamp.

Yet another embodiment of the present invention is directed to a gas discharge lamp control circuit, which includes alternating-current (AC) input terminals, lamp output terminals for coupling across a gas discharge lamp, and a ballast coupled between the AC input terminals and the lamp output terminals. Further, a voltage sensor senses a voltage in the circuit that is representative of AC voltage delivered to the lamp output terminals and produces a first measurement output. A current sensor senses a current in the circuit that is representative of AC current delivered to the lamp output terminals and produces a second measurement output. An absolute value circuit takes the absolute values of the first and second measurement outputs. A modulator pulse-width modulates one of the absolute values of the first and second measurement outputs with the other of the absolute values of the first and second measurement outputs to produce a pulse-width modulated output. A low-pass filter filters the pulse-width modulated output to produce a DC voltage representative of average power delivered to the lamp.

DETAILED DESCRIPTION OF THE ILLUSTRATIVE EMBODIMENTS

Figure 1:
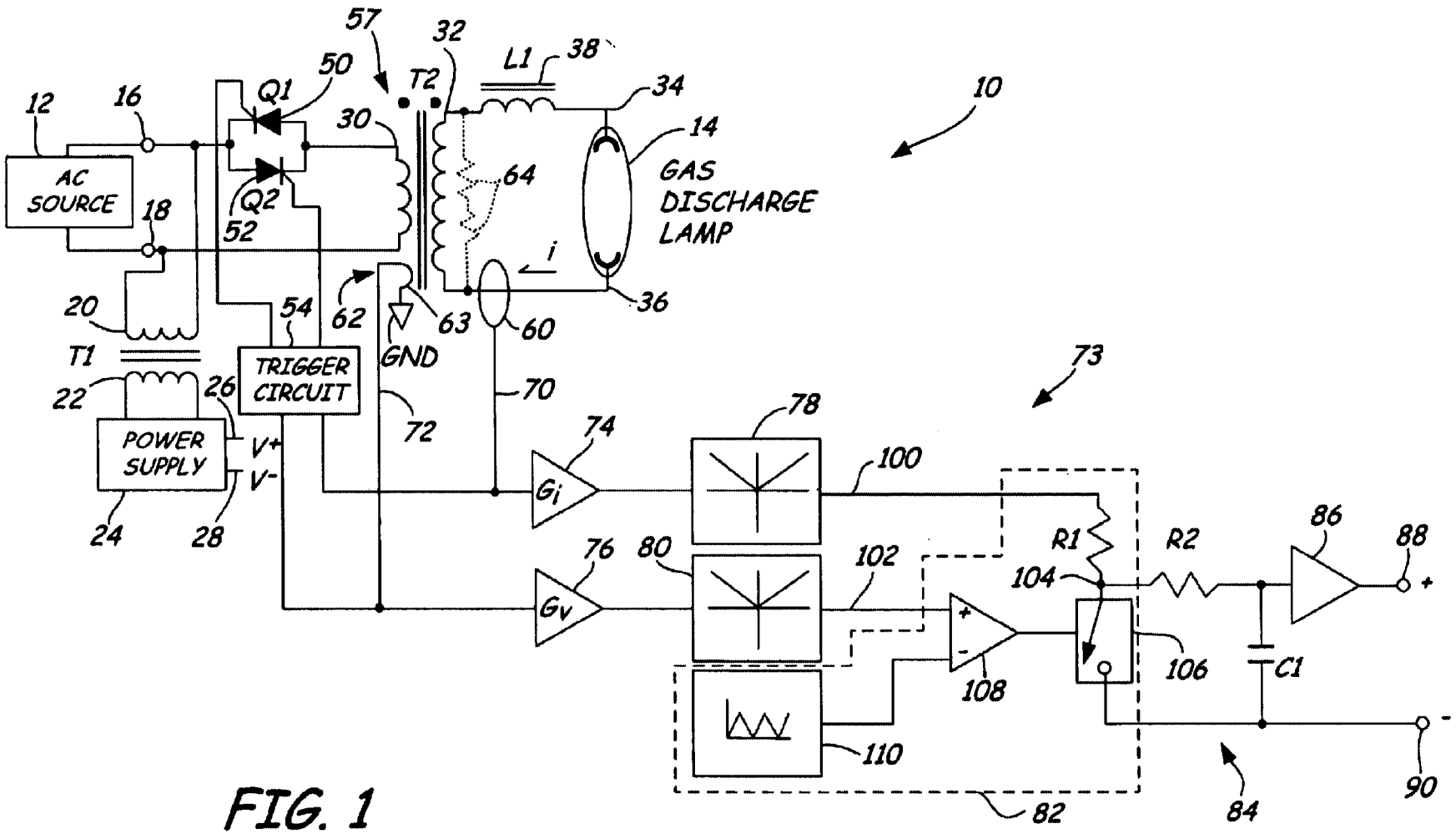
FIG. 1 is a diagram of a control circuit for a gas discharge lamp, which has a lamp power measurement circuit according to one embodiment of the present invention.

FIG. 1 is a diagram of a control circuit 10 which is capable of controlling a gas discharge lamp and producing an output representative of the average power delivered to the lamp. Control circuit 10 is coupled between an AC source 12 and the lamp 14. AC source 12 provides an AC drive signal, such as a utility line voltage, which has a plurality of sequential positive and negative half cycles. The AC drive signal can have any suitable voltage and frequency, such 480 Volts AC at 60 Hz.

AC source 12 is connected to input terminals 16 and 18. A control transformer T1 has a primary winding 20 coupled to input terminals 16 and 18 and a secondary winding coupled to a DC power supply 24. DC power supply 24 is a conventional power supply which, in one embodiment, provides a regulated V+ and V− voltage on terminals 26 and 28 for powering the various components in control circuit 10.

Control circuit 10 further includes a ballast transformer T2 having a primary winding 30 and a secondary winding 32. Primary winding 30 is coupled to input terminals 16 and 18 for receiving the AC drive signal from AC source 12. Secondary winding 32 is coupled to gas discharge lamp 14 through lamp output terminals 34 and 36. A current limiting inductor 38 is coupled in series with gas discharge lamp 14. Inductor 38 can be either a physically separate inductor or "built-in" to the power transformer T2 as a leakage inductance. In the embodiment shown in FIG. 1, transformer T2 has a step-up voltage characteristic to provide a high voltage for striking and maintaining current conduction through gas discharge lamp 14.

Referring back to the primary side of transformer T2, phase control is provided through a pair of anti-parallel connected silicon controlled rectifiers (SCR's) 50 and 52 which are labeled "Q1" and "Q2". SCR's 50 and 52 are coupled in series with primary winding 30 to control the average AC power delivered to primary winding 30 and thus to gas discharge lamp 14. SCR 50 has its anode coupled to primary winding 30, its cathode coupled to input terminal 16 and its gate coupled to trigger circuit 54. SCR 52 has its anode coupled to input terminal 16, its cathode coupled to primary winding 30 and its gate coupled to trigger circuit 54. SCR 50 conducts current of the AC drive signal in the negative direction as defined by dots 57 shown on power transformer T2. SCR 52 conducts current of the AC drive signal in the positive direction. The SCR's can be substituted with other types of power switching devices, such as other thyristors or power transistors.

Trigger circuit 54 triggers SCR's 50 and 52 through their gates at the appropriate times in each respective half-cycle of the AC drive signal to control a desired overall current delivered to lamp 14. Trigger circuit 54 also controls each SCR independently of the other to maintain a correct balance of current delivered between positive and negative half-cycles. One example of a suitable trigger circuit 54 is disclosed in U.S. Pat. No. 5,578,908, which is hereby incorporated by reference and is commercially available from Nicollet Technologies Corporation of Minneapolis, Minn. as part of its Electronic Ballast System.

Trigger circuit 54 makes phase angle adjustments for the triggering of each SCR 50 and 52 during their respective half-cycles based on a measurement outputs from current sensor 60 and voltage sensor 62. Current sensor 60 is coupled in series with gas discharge lamp 14 on the secondary side of ballast transformer T2. Current sensor 60 generates a measurement output 70, which represents a current (i) delivered through lamp 14. Current sensor 60 can include a conventional current transformer, a Hall-effect transducer, a resistive element with an appropriate amplifier circuit, or any other type of measuring transducer. Measurement output 70 can be a voltage, as shown in FIG. 1, or a current, for example.

Voltage sensor 62 includes an accessory winding 63 within the primary side of transformer T2. One end of winding 63 is coupled to ground terminal GND, and the other end of winding 63 forms a measurement output 72. During operation, accessory winding 63 develops an AC voltage which is representative of the AC voltage developed across secondary winding 32. This voltage is different from the voltage across lamp 14 in a ballast in which inductor 38 is a stand-alone inductor. If inductor 38 is assumed to be ideal, inductor 38 will have no power dissipation so the measured power at transformer T2 is exactly the same as the power delivered to lamp 14. In a real inductor, the power loss through the inductor is small, so the power measured at transformer T2 is a fairly accurate representation of the power delivered to lamp 14.

In an alternative embodiment, accessory winding 63 is replaced with one or more resistors 64 (shown in phantom) which are coupled in series with one another across secondary winding 32. The voltage developed across one or more of these resistors 64 can then be provided as measurement output 70. Alternatively, resistors 64 can be coupled across lamp 14. Other voltage sensor circuits can also be used in further alternative embodiments of the present invention, and can be coupled in various locations within circuit 10 as long as the sensed voltage is representative of the voltage across lamp 14. However, the use of primary-side accessory winding 63 allows the voltage measurements to be made at the lower, primary-side voltage levels rather than at the much higher secondary-side voltage levels. This reduces the cost of the sensor components and improves reliability.

Measurement outputs 70 and 72 are fed back to trigger circuit 54 for controlling the phase angles of SCR's 50 and 52, as discussed above, and for measuring the average power delivered to lamp 14, a discussed below. The voltage feedback is used to determine when lamp 14 has warmed up. When lamp 14 is turned on and it is cold, the voltage across lamp 14 will be much smaller than the normal operating voltage. As lamp 14 warms up, the voltage will increase to the normal operating level. To reduce warm up time, lamp 14 is driven with a greater current than its normal maximum current. This is just temporary. In the Electronic Ballast System available from Nicollet Technologies Corporation, for example, the trigger circuit has the ability to set the warm up current between 50% and 300% of the normal maximum current in 25% increments. When the voltage across lamp 14 increases to a threshold that is about 80% of the normal operating voltage, for example, the trigger circuit switches from a warm up mode to a run mode. During warm up mode, the lamp current is controlled to be equal to the set warm up value. During run mode, the lamp current is controlled by the user through an external input (not shown) to the trigger circuit.

Control circuit 10 further includes a lamp power measurement circuit 73, which measures the average power delivered to lamp 14 based on the instantaneous values of measurement outputs 70 and 72. Once measured, the average lamp power can then be fed back to trigger circuit 54 or to an overall process control circuit for controlling the operation of circuit 10 and trigger circuit 54.

Lamp power measurement circuit 73 includes current sensor 60, voltage sensor 62, scaling amplifiers 74 and 76, absolute value circuits 78 and 80, pulse width modulator 82, low-pass filter 84, output buffer 86 and lamp power measurement outputs 88 and 90. Measurement output 70 is coupled to the input of scaling amplifier 74. Measurement output 72 is coupled to the input of scaling amplifier 76. Scaling amplifiers 74 and 76 scale measurement outputs 70 and 72 to a desired measurement range, such as 0–10 volts. Scaling amplifiers 74 and 76 are optional and can be removed in alternative embodiments of the present invention.

The outputs of scaling amplifiers 74 and 76 are provided to the inputs of absolute value circuits 78 and 80, respectively. Absolute value circuits 78 and 80 receive the scaled AC measurement outputs 70 and 72 and produce respective absolute value outputs 100 and 102. Absolute value outputs 100 and 102 are pulsating DC signals. In the embodiment shown in FIG. 1, pulse width modulator 82 modulates absolute value output 100 with absolute value output 102 to produce a pulse-width modulated signal on output 104. In an alternative embodiment, outputs 100 and 102 are reversed such that output 102 is pulse-width modulated with output 100.

Pulse width modulator 82 includes resistor R1, switch 106, comparator 108 and waveform generator 110. In one embodiment, resistor R1 is a 1 kΩ resistor, but other suitable resistor values could also be used. Resistor R1 and switch 106 are coupled together in series between absolute value output 100 and lamp power measurement output 90. In one embodiment, lamp power measurement output 90 is coupled to ground terminal GND. Switch 106 has a switch control input 112 which is coupled to the output of comparator 108. Comparator 108 has a non-inverting input coupled to absolute value output 102 and an inverting input coupled to the output of waveform generator 110.

Waveform generator 110 generates a linearly-varying periodic waveform, which is applied to the inverting input of comparator 108. In one embodiment, waveform generator 110 generates a triangular waveform. However, other waveforms can also be used such as a sawtooth waveform. The linearly-varying periodic waveform preferably has a frequency of at least two or more orders of magnitude greater than the frequency of the AC drive signal.

During operation, if the voltage on the non-inverting comparator input, V(+), is greater than the voltage on the inverting comparator input, V(−), then switch 106 is open. If V(+)<V(−), then switch 106 is closed. When switch 106 is open, resistor R1 pulls pulse-width modulated output 104 to the voltage on absolute value output 100. When switch 106 is closed, switch 106 pulls output 104 to ground. The times during which switch 106 is open and closed is a function of the width of the pulses in absolute value output 102. Other types of pulse-width modulators can also be used in alternative embodiments of the present invention.

The pulse-width modulated output 104 is coupled to low-pass filter 84. Low-pass filter 84 includes resistor R2 and capacitor C1. In one embodiment, resistor R2 is a 1 MΩ resistor and capacitor C1 is a 1 $\mu$F capacitor. However, any other suitable resistor and capacitor values can also be used. Resistor R2 is coupled in series between output 104 and the input of output buffer 86. Capacitor C1 is coupled between the input of output buffer 86 and lamp power measurement output 90 (ground terminal GND). Other types of low-pass filters and filter circuits can also be used. Low-pass filter 84 produces a DC voltage having a magnitude that is a function of the product of the instantaneous lamp voltage and lamp current and, thus, a function the average power delivered through lamp 14. Output buffer 86 amplifies this DC voltage onto lamp power measurement output 88. Output buffer 86 is also optional.

Pulse width modulator 82 is a one implementation of the "multiplication" function. Outputs 100 and 102 are multiplied together to produce the output at 104. However, output 104 also includes unwanted high frequencies that are left over from the pulse width modulation (PWM). Low-pass filter 84 removes these unwanted high frequencies. Low-pass filtering also produces a signal that is proportional to the average power delivered to lamp 14. It would be possible set the cut-off frequency of filter 84 so that the high frequency PWM effects were removed, but, still have the power at the lamp as a function of time (where it shows 120 Hz and harmonics variations), for example.

The DC voltage produced on output 88 and 90 can then be used to drive a variety of functions, such as an analog or digital power meter display, a power control function within trigger circuit 54 or as a feedback control input to the equipment that is using circuit 10. Also, this DC voltage can be supplied to other test equipment or instrumentation associated with the process in which circuit 10 is used.

As mentioned above, voltage sensor 62 *is measuring the voltage at the transformer. In some cases, the lamp voltage is not being measured directly. The lamp voltage is different from the transformer voltage on ballasts that have a stand-alone inductor. This circuit is actually measuring the power at the transformer. An ideal inductor will have no power dissipation so the measured power at the transformer output would be exactly the same as the power delivered to the lamp on the average. In a real inductor, the power loss in the inductor is small, so the power indicator will work with reasonable accuracy to display the lamp power.

In some traditional systems having ultraviolet light (UV) ballasts, the systems use open loop control of the lamp current. The lamp is turned on to effect some change in the process. Some systems control then current in an open loop fashion as the next step in the process. This open loop control is often determined by trial and error in order to select the appropriate current levels.

With the power signal provided at outputs 88 and 90 of the circuit shown in FIG. 1, closed loop feedback can be used to control the lamp power. For example, a particular process may require the lamp run at a power level of 10 kW in order to achieve a particular effect in the process. The lamp may have a particular output characteristic at or above the given power level. This characteristic may not be directly dependent on lamp current or lamp voltage. With the embodiment of the present invention shown in FIG. 1, the process controller can vary the input current through trigger circuit 54 to maintain a 10 kW output from lamp 14. Feedback on power control could remove the dependence on input voltage and input frequency.

The combination of voltage feedback at output 72, current feedback at output 70, and power feedback at output 88/90 can also give the user an indication of when to replace lamp 14 without waiting until the lamp fails. Replacement of lamp 14 could be done on total accumulated power or based on changes in voltage or current to obtain the desired power.

As mentioned above, other multiplication circuits can also be used. Another low cost multiplication circuit is a Multiplying Digital to Analog Converter (MDAC). To implement an MDAC, one of the signals 70 and 72 is digitized at a high sampling rate by an analog to digital converter. The digital signal then sent to the digital input of the MDAC. The other of the signals 70 and 72 is used as an analog "reference" input to the MDAC. The MDAC then produces an output, which is equal to the reference input weighted (or multiplied by) the digital input. Low pass filtering is used to remove the sampling effects and to produce a signal proportional to the average lamp power.

Amplitude and frequency modulation circuits can also implement multiplication. A microprocessor or other digital device could do multiplication in a binary format. Analog multipliers also exist that use diodes in the feedback sections of op-amp circuits.

Figures 2E, 2F, 2G, 2H, 2I, 2J:
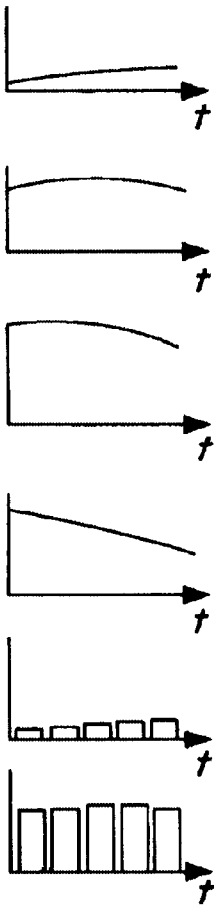
FIGS. 2A–2J are waveform diagrams illustrating various waveforms produced during operation of the circuit shown in FIG. 1.
Figures 2A, 2B, 2C, 2D:
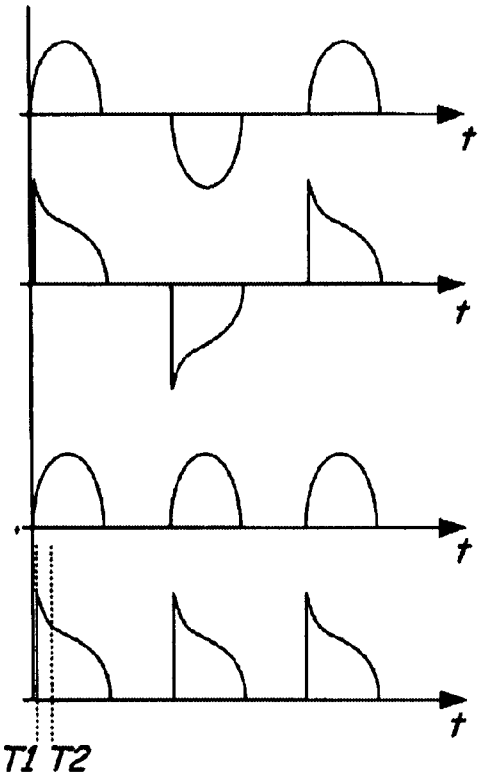

FIGS. 2A–2J are waveform diagrams illustrating various waveforms produced by circuit 10 during operation. FIG. 2A shows a typical lamp current waveform as a function of time, as sensed by current sensor 60 shown in FIG. 1. FIG. 2B shows a typical lamp voltage waveform as a function of time, as sensed by voltage sensor 63 shown in FIG. 1. FIGS. 2C and 2D show the resulting absolute values of the lamp current and lamp voltage at outputs 100 and 102 generated by absolute value circuits 78 and 80, respectively. FIGS. 2E and 2F show expansions of the lamp current waveform shown in FIG. 2C at times T1 and T2, respectively. Similarly, FIGS. 2G and 2H show expansions of the lamp voltage waveform shown in FIG. 2D at times T1 and T2, respectively.

FIG. 2I shows the pulse width modulated signal at output 104 for time T1. The amplitude of the pulses is proportional to the lamp current shown in FIG. 2E, and the width of the pulses proportional to the lamp voltage shown in FIG. 2G. The pulse width begins near a maximum value, and is decreasing. The pulse amplitude is increasing.

FIG. 2J shows the pulse width modulated signal at output 104 for time T2. Again, the amplitude of the pulses is proportional to the lamp current shown in FIG. 2F, and the width of the pulses proportional to the lamp voltage shown in FIG. 2H. The pulse width begins at about ⅔ a maximum value, and is decreasing. The pulse amplitude is peaking.

The net result is that the pulse width modulated signal at output 104 reflects the instantaneous multiplication of the lamp current and amp voltage, which is then filtered to obtain a measure of the average power delivered to the lamp.

In summary, lamp power measurement circuit shown in FIG. 1 allows the average power delivered to a gas discharge lamp to be measured using inexpensive analog components that can be fabricated on the same circuit board or assembly as the control circuit at a very little increase in cost.

Although the present invention has been described with reference to preferred embodiments, workers skilled in the art will recognize that changes may be made in form and detail without departing from the spirit and scope of the invention. For example, the term "coupled" used in the specification and the claims can include a direct connection or a connection through one or more intermediate components.

What is claimed is:

1. A lamp power measurement circuit for measuring average power delivered to a gas discharge lamp, comprising:

a voltage sensor having a first measurement output representative of AC voltage across the lamp;

a current sensor having a second measurement output representative of AC current through the lamp;

a first absolute value circuit coupled in series with the first measurement output and having a first absolute value output;

a second absolute value circuit coupled in series with the second measurement output and having a second absolute value output;

a pulse-width modulator, which modulates one of the first and second absolute value outputs with the other of the first and second absolute value outputs and has a pulse width modulated output; and a low-pass filter coupled in series with the pulse width modulated output and having a DC voltage output representative of average power dissipated through the lamp.

2. The lamp power measurement circuit of claim 1 and further comprising first and second scaling amplifiers coupled in series between the first and second measurement outputs, respectively, and the first and second absolute value circuits, respectively.

3. The lamp power measurement circuit of claim 1 wherein the pulse-width modulator comprises:

a resistor and a switch coupled in series with one of the first and second absolute value outputs, wherein the switch has a switch control terminal;

a comparator having a first comparator input coupled to the other of the first and second absolute value outputs, a second comparator input, and a comparator output coupled to the switch control terminal; and a waveform generator having a linearly-varying periodic waveform output, which is coupled to the second comparator input.

4. The lamp power measurement circuit of claim 1 and further comprising an output buffer coupled in series with the pulse-width modulated output.

5. The lamp power measurement circuit of claim 1 wherein the voltage sensor comprises an accessory winding on a primary side of a transformer.

6. The lamp power measurement circuit of claim 1 wherein the current sensor comprises a Hall effect current sensor.

7. A gas discharge lamp control circuit comprising:

alternating-current (AC) input terminals;

lamp output terminals for coupling across a gas discharge lamp;

a ballast coupled between the AC input terminals and the lamp output terminals;

a voltage sensor coupled in the circuit to produce a first measurement output representative of AC voltage across the lamp output terminals;

a current sensor coupled in the circuit to produce a second measurement output representative of AC current through the lamp output terminals;

a first absolute value circuit coupled in series with the first measurement output to produce a first absolute value output;

a second absolute value circuit coupled in series with the second measurement output to produce a second absolute value output;

a pulse-width modulator, which modulates one of the first and second absolute value outputs with the other of the first and second absolute value outputs to produce a pulse-width modulated output; and a low-pass filter coupled to the pulse-width modulated output.

8. The gas discharge lamp control circuit of claim 7 and further comprising first and second scaling amplifiers coupled in series between the first and second measurement outputs, respectively, and the first and second absolute value circuits, respectively.

9. The gas discharge lamp control circuit of claim 7 wherein the pulse-width modulator comprises:

a resistor and a switch coupled in series with one of the first and second absolute value outputs, wherein the switch has a switch control terminal;

a comparator having a first comparator input coupled to the other of the first and second absolute value outputs, a second comparator input, and a comparator output coupled to the switch control terminal; and a waveform generator having a linearly-varying periodic waveform output, which is coupled to the second comparator input.

10. The gas discharge lamp control circuit of claim 7 and further comprising an output buffer coupled in series with the pulse-width modulated output.

11. The gas discharge lamp control circuit of claim 7 wherein the current sensor comprises a Hall effect current sensor coupled in series with one of the lamp output terminals.

12. The gas discharge lamp control circuit of claim 7 wherein:

the ballast comprises a transformer having a primary winding coupled to the AC input terminals and a secondary winding coupled to the lamp output terminals; and the voltage sensor comprises an accessory winding on a primary side of the transformer.

13. The gas discharge lamp control circuit of claim 12 and further comprising an inductor coupled in series with the secondary winding.

14. The gas discharge lamp control circuit of claim 7 wherein:

the ballast comprises a transformer having a primary winding coupled to the AC input terminals and a secondary winding coupled to the lamp output terminals; and the voltage sensor comprises at least one resistor coupled in parallel across the secondary winding.

15. The gas discharge lamp control circuit of claim 14 and further comprising an inductor coupled in series with the secondary winding, between the voltage sensor and one of the lamp output terminals.

16. A method of measuring power delivered to a gas discharge lamp by a lamp control circuit, the method comprising:

(a) sensing a voltage representative of AC voltage delivered to the lamp and producing a first measurement output;

(b) sensing a current representative of AC current delivered to the lamp and producing a second measurement output;

(c) taking the absolute values of the first and second measurement outputs;

(d) pulse-width modulating one of the absolute values of the first and second measurement outputs with the other of the absolute values of the first and second measurement outputs to produce a pulse-width modulated output; and (e) low-pass filtering the pulse-width modulated output to produce a DC voltage representative of average power delivered to the lamp.

17. The method of claim 16 wherein the lamp control circuit includes a transformer having a primary winding coupled to an AC input and a secondary winding coupled to the lamp, and wherein:

step (a) comprises sensing a voltage developed across an accessory winding on a primary side of the transformer.

18. The method of claim 16 wherein the lamp control circuit includes a transformer having a primary winding coupled to an AC input and a secondary winding coupled to the lamp, and wherein:

step (a) comprises sensing a voltage developed across the secondary winding of the transformer.

19. The method of claim 16 wherein the lamp control circuit includes a transformer having a primary winding coupled to an AC input and a secondary winding coupled to the lamp, and wherein:

step (a) comprises sensing a voltage developed directly across the lamp output terminals.

20. The method of claim 16 and further comprising:

(f) scaling the first and second measurement outputs prior to performing step (c).

21. The method of claim 16 wherein step (d) comprises:

(d)(1) passing one of the first and second absolute value outputs through a resistor, which is coupled to a ground terminal through a switch;

(d)(2) comparing the other of the first and second absolute value outputs with a linearly varying periodic waveform to produce a comparison output; and (d)(3) controlling the switch as a function of the comparison output.

22. A gas discharge lamp control circuit comprising:

alternating-current (AC) input terminals;

lamp output terminals for coupling across a gas discharge lamp;

a ballast coupled between the AC input terminals and the lamp output terminals;

voltage sensing means for sensing a voltage in the circuit that is representative of AC voltage delivered to the lamp output terminals and for producing a first measurement output;

current sensing means for sensing a current in the circuit that is representative of AC current delivered to the lamp output terminals and for producing a second measurement output;

absolute value means for taking the absolute values of the first and second measurement outputs;

modulator means for pulse-width modulating one of the absolute values of the first and second measurement outputs with the other of the absolute values of the first and second measurement outputs to produce a pulse-width modulated output; and filtering means for low-pass filtering the pulse-width modulated output to produce a DC voltage representative of average power delivered to the lamp.

* * * * *